US006222461B1

(12) United States Patent
Hazen

(10) Patent No.: US 6,222,461 B1
(45) Date of Patent: Apr. 24, 2001

(54) EMERGENCY WARNING SYSTEM FOR VEHICLES

(76) Inventor: Gary L. Hazen, 11137 Windemere Blvd., Fisher, IN (US) 46038

( * ) Notice: Subject to any disclaimer, the term of this patent is extended or adjusted under 35 U.S.C. 154(b) by 0 days.

(21) Appl. No.: 09/587,328

(22) Filed: Jun. 5, 2000

(51) Int. Cl.[7] ..... G08G 1/00

(52) U.S. Cl. ..... 340/901; 340/903; 340/904; 340/905; 340/933; 340/436; 340/539

(58) Field of Search ..... 340/901, 902, 340/903, 904, 905, 933, 436, 539

(56) References Cited

U.S. PATENT DOCUMENTS 5,926,112 * 7/1999 Hartzell ..... 340/902

6,025,789 * 2/2000 Lane et al. ..... 340/933

* cited by examiner

*Primary Examiner*—Daryl Pope

(74) *Attorney, Agent, or Firm*—Daniel J. O'Connor

(57) ABSTRACT

An emergency warning system for buses, trucks or other vehicles. The system warns a driver of a potentially dangerous condition such as the approach of a train at a railroad crossing or the approach or presence of an emergency vehicle such as an ambulance, fire truck or police unit. A dedicated radio or other frequency is transmitted directly to to the bus or vehicle and a warning light and audible warning sound is generated. Multiple dedicated frequencies may be utilized in the system.

1 Claim, 2 Drawing Sheets

EMERGENCY WARNING SYSTEM FOR VEHICLES

BACKGROUND AND OBJECTS OF THE INVENTION

The present invention is generally related to the emergency warning system arts and, in particular, to a system and method to warn a motorist of an approaching train or locomotive. The system described is also useful to warn motorists of an approaching or nearby ambulance, fire truck or police vehicle.

As is known in the art, the number of railway crossing collisions, fatalities and injuries annually in the United States is quite startling.

Based upon an NBC News study for 1999, there are 160,000 public highway and rail intersections in the U.S. Of this number, 60 percent or over 96,000 lack warning gates and lights. There were over 3400 train-vehicle collisions in 1999 which resulted in 399 deaths and 1,360 persons injured.

As is also known in the art, the number of collisions between vehicles and ambulances, fire trucks and police cars is also very high and results in many deaths and injuries annually.

Accordingly, it is an object of the present invention to set forth an efficient on-board warning system to alert a vehicle driver of a potentially dangerous condition such as the approach of a train, locomotive or emergency vehicle.

It is also an object of the invention to demonstrate a warning system for the above purposes which may be economically mass-produced and installed for widespread commercial appeal.

These and other objects and advantages of the invention will be apparent to those of skill in the art from the description which follows.

PRIOR ART PATENTS AND DESIGNS

U.S. Pat. No. 5,729,213 teaches the use of a train warning system which uses a receiver/transmitter mounted to the crossbucks at a railroad crossing. While effective for the purposes described, this patent would require costly installations at each railroad crossing to achieve the desired results.

The present invention teaches a more efficient train warning system and also provides an on-board unit to warn of other potential hazards such as emergency or police vehicles.

The present invention is thus believed to be clearly patentable over all known prior art systems.

SUMMARY OF THE INVENTION

A locomotive is equipped with a transmitter device which sends a focused signal at a particular radio or radar frequency which is dedicated only to trains.

An on-board, in-vehicle receiver unit responds to this train frequency, Frequency A, by activating visible, audible and/or vibratory warning signals.

The in-vehicle unit is also designed to respond with warning signals when other frequencies(B, C, or D) are detected. These other frequencies could be dedicated to ambulance, fire or police units respectively.

The receiver may be portable for easy placement in any vehicle. While especially useful for buses and trucks, the overall design has utility in combination with any automotive vehicle and may be factory installed in new vehicles or used in an after-market fashion.

BRIEF DESCRIPTION OF THE DRAWING FIGURES

DESCRIPTION OF A PREFERRED EMBODIMENT

Figure 1:
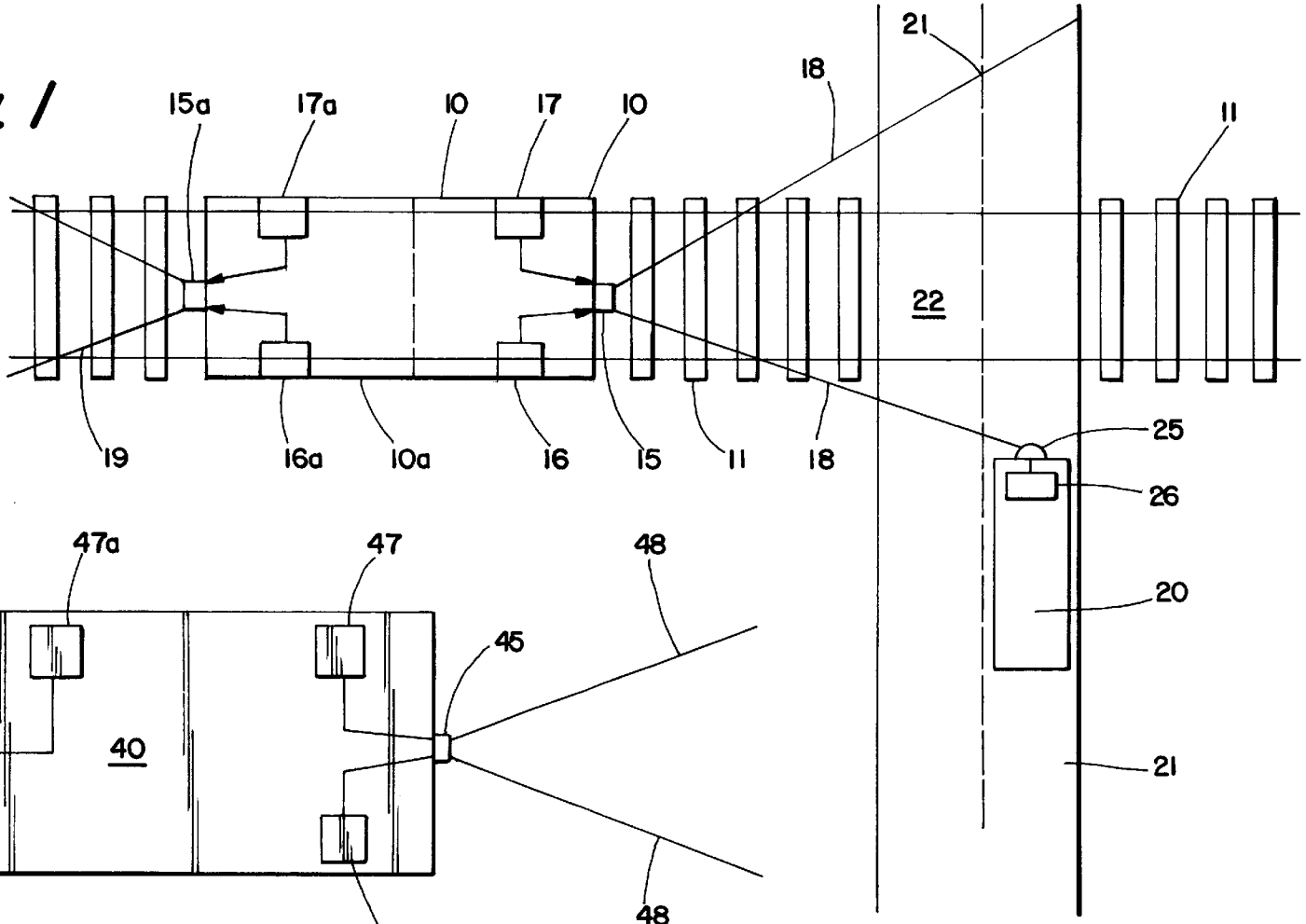
FIG. 1 shows an overhead schematic of a train approaching a railroad crossing an indicates a focused signal being sent to a vehicle on a roadway.

Referring to the drawing figures, FIG. 1 shows a locomotive 10 on railway track 11 approaching a railway intersection 22. A vehicle 20, such as a bus or truck, is on roadway 21 and is also approaching the railway intersection 22.

When the locomotive 10 is in forward motion, a motion sensor 16 serves to activate a low-power radio frequency transmitter 15 which transmits at a particular dedicated Frequency A as indicated at numeral 18.

Vehicle 20 is equipped with an on-board in-vehicle receiver unit 25 which, when Frequency A is detected, serves to activate a warning light 26*a* on the dashboard of vehicle 20. After a brief time delay, indicated at numeral 27*a*, an audible warning is given as indicated at numeral 28*a*. See drawing FIG. 2.

The audible warning means 28*a* would preferably be a verbal caution such as "Locomotive Approaching" which is given several times.

The locomotive radio transmitter system 15 may also be equipped with a manual over-ride switch 17 in the event the locomotive operator wishes to activate signal 18 to warn that the locomotive is about to move forward.

The rear of the locomotive or the last car on a train 10*a* may be similarly equipped with a low-power radio frequency transmitter 15*a*, motion sensor 16*a* and manual over-ride 17*a*.

A signal 19 at the train-dedicated Frequency A is thus generated if the locomotive/train is moving in a reverse direction. It serves to warn any vehicles which may be approaching on a roadway behind the locomotive/train.

Figure 2:
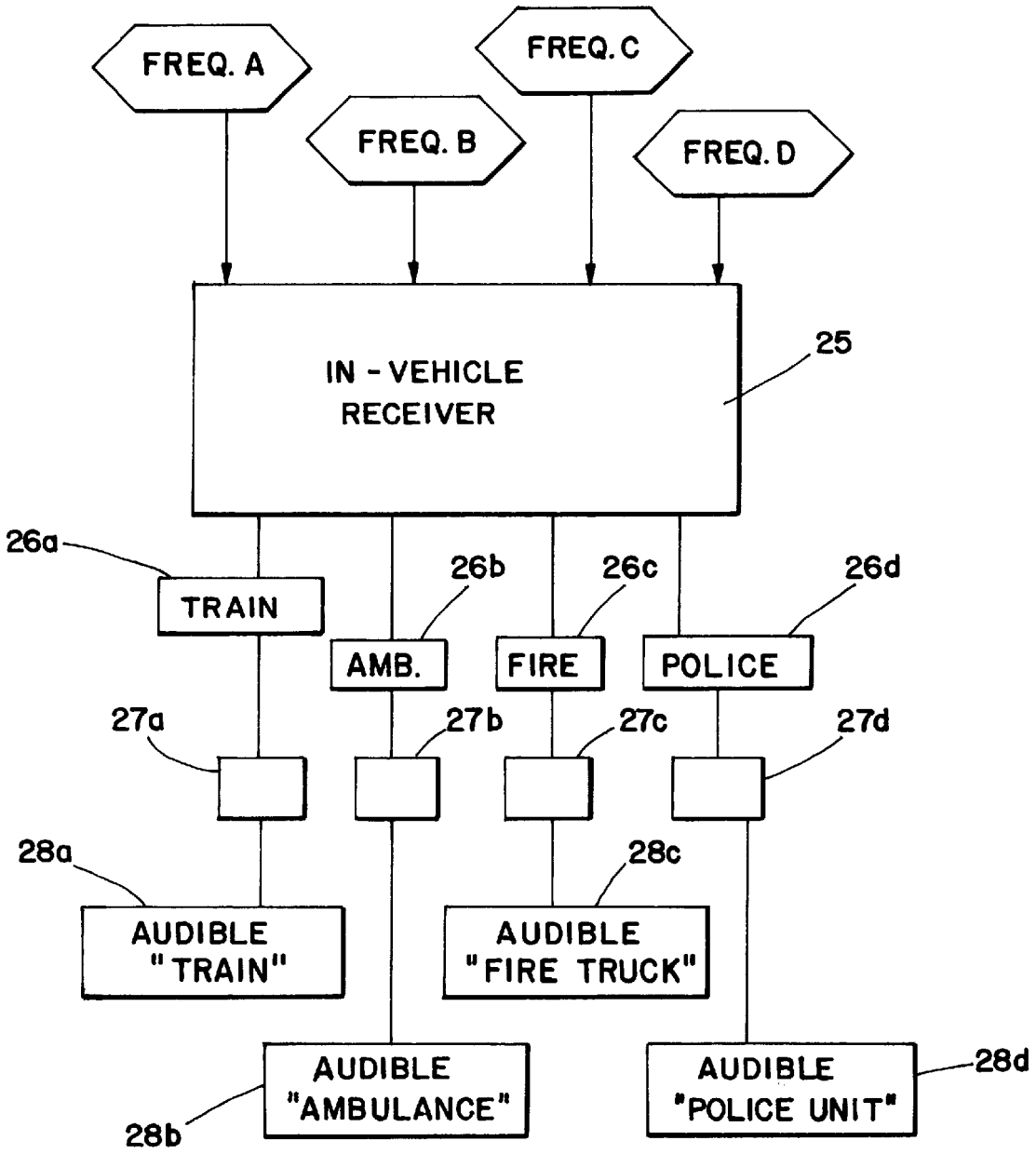
FIG. 2 is a schematic view of the in-vehicle receiver which receives the train-dedicated Frequency A and is also capable of receiving other Frequencies B, C and D which may be dedicated to ambulance, fire and police units respectively.

As further indicated in FIG. 2, the in-vehicle receiver 25 may also sense other dedicated frequencies such as Frequency B, Frequency C and Frequency D.

When Frequency B is received, for example, a warning light 26*b* which reads "AMBULANCE" is flashed on the dashboard of vehicle 20.

After a brief time delay, indicated at numeral 27*b*, an audible warning is given at numeral 28*b* which may verbally state "Ambulance In Area" several times.

The in-vehicle receiver 25 may also sense a Frequency C dedicated to fire truck vehicles and show a "FIRE TRUCK" light as indicated at numeral 26*c* and verbally state "Fire Truck" as indicated at numeral 28*c*.

A fourth frequency(Frequency D) may also be sensed by the receiver 25. Such could, for example, be dedicated to police vehicles and give a "POLICE" warning sign and verbal warning as indicated a numerals 26*d* and 28*d*.

Figure 3:
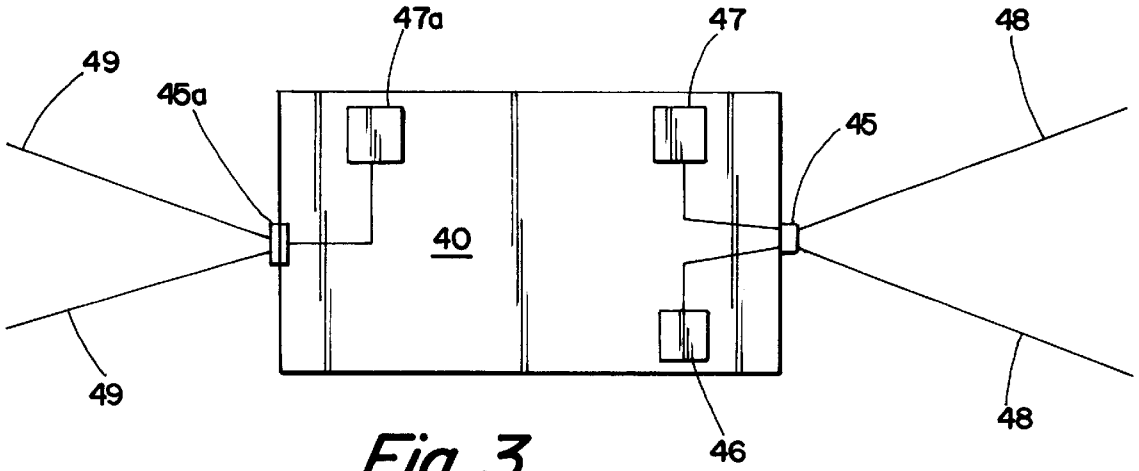
FIG. 3 is an overhead schematic view of an ambulance, fire or police unit and indicates how the present invention may be effectively utilized in combination with such emergency vehicles.

FIG. 3 is an overhead schematic view of an emergency vehicle 40 such as an ambulance, fire truck or police vehicle. A low-power radio frequency transmitter 45 is shown as generating a signal 48.

The transmitter 45 may be activated by the siren or flashing light circuitry 46 of the vehicle or manually activated by switch 47.

In FIG. 3, the emergency vehicle 40 is also shown to have a rear transmitter 45*a* which generates a signal 49. Such signal is activated by a switch 47*a* at the choice of the vehicle operator.

For example, if a police or ambulance vehicle were at the side of a roadway to assist in an emergency, the rear warning signal 49 could be activated so that motorists approaching the scene could be alerted.

Such would be very helpful since many police and emergency personnel are injured or killed at the side of a roadway while rendering emergency assistance.

The display and verbal warning circuitry described are of types known in the electrical arts but which have not been used in the particular combination described herein.

While a particular system has been shown and described, it is intended in this specification to broadly cover all equivalent systems and methods which would reasonably occur to those of skill in the art.

Among the many advantages of the present invention, the overall system and method provides a clear warning to motorists of potentially hazardous conditions.

Injuries to ambulance, police and fire personnel will be reduced. The State of Indiana, for example, has recently passed legislation requiring motorists to move to a lane away from a roadside police vehicle in response to fatalities of State Troopers. The present system would aid in complying with this and other recently enacted laws.

It is contemplated that the system would be legislatively required for certain vehicles such as buses and hazardous material cargo trucks where any accident may be one of disastrous proportions.

The system described is economical to manufacture and may be designed as a portable add-on unit for easy addition to the dash or display area of any vehicle.

I claim:

1. An emergency warning system in combination with a roadway vehicle(20) and a locomotive(10), transmitter means(15) mounted on said locomotive for transmitting a single radio frequency(A) dedicated only to trains, receiver means(25) mounted on said roadway vehicle for said single frequency dedicated only to trains, display means(26) mounted within said roadway vehicle for indicating to an operator an approaching train condition, activation means(16) connected to said locomotive transmitter(15) for turning on said transmitter when said locomotive is in forward motion, said emergency warning system providing means whereby said single dedicated train frequency(A) is transmitted directly from said locomotive(10) to said roadway vehicle(20), said receiver(25) in said roadway vehicle being capable of receiving at least one other dedicated frequency(B) means which is dedicated only to an emergency vehicle such as an ambulance, wherein the receiver means(25) mounted in said roadway vehicle is also capable of receiving a third dedicated frequency which is dedicated only to an emergency vehicle such as a fire truck, said receiver means(25) mounted in said roadway vehicle being also capable of receiving a fourth dedicated frequency(D) which is dedicated only to an emergency vehicle such as a police unit, wherein a rear portion(10*a*) of said locomotive or train has a transmitter means(15*a*) to transmit a signal(19) in a rearward direction, said signal being of a certain dedicated frequency(A) dedicated only to locomotives and trains, wherein each of said locomotive transmitter means(15,15*a*) are separate and distinct from any F S K or head end transmitter which may be contained in said locomotive, wherein said rear transmitter means(15*a*) is activated by a rearward motion sensor(16*a*), said rear transmitter means(15*a*) being capable of being manually activated by means(17*a*) so the locomotive operator can indicate that motion is about to occur in a rearward direction, wherein said forward motion transmitter means(15) is capable of being manually activated by means(17) so the locomotive operator can indicate that motion is about to occur in a forward direction, wherein said emergency vehicles(40) such as a police car, fire truck or ambulance are equipped with a forward transmitter(45) for transmitting a forward signal(48), and wherein said emergency vehicles(40) are also equipped with a rear manually activated transmitter (45*a*) means to transmit a rearward signal(49) to warn motorists of a roadside emergency.

* * * * *